US007931761B2

(12) United States Patent
Banister et al.

(10) Patent No.: US 7,931,761 B2
(45) Date of Patent: Apr. 26, 2011

(54) MICRO THRUSTER, MICRO THRUSTER ARRAY AND POLYMER GAS GENERATOR

(76) Inventors: Mark Banister, Tucson, AZ (US); Stephen Banister, Tucson, AZ (US)

( * ) Notice: Subject to any disclaimer, the term of this patent is extended or adjusted under 35 U.S.C. 154(b) by 69 days.

(21) Appl. No.: 12/414,536

(22) Filed: Mar. 30, 2009

(65) Prior Publication Data

US 2009/0236018 A1 Sep. 24, 2009

(51) Int. Cl.

| | |
|---|---|
| ***C06B 45/00*** | (2006.01) |
| ***C06B 45/04*** | (2006.01) |
| ***C06B 45/06*** | (2006.01) |
| ***D03D 23/00*** | (2006.01) |
| ***D03D 43/00*** | (2006.01) |

(52) U.S. Cl. ..... 149/2; 149/17; 149/18; 149/108.4; 149/109.2; 149/109.4

(58) Field of Classification Search ..... 149/2, 17, 149/18, 108.4, 109.2, 109.4
See application file for complete search history.

(56) References Cited

U.S. PATENT DOCUMENTS

| | | | | |
|---|---|---|---|---|
| 6,378,292 | B1 | 4/2002 | Youngner | 60/224 |
| 6,864,295 | B2 * | 3/2005 | Mitarai | 521/50.5 |
| 7,544,260 | B2 * | 6/2009 | Banister et al. | 149/2 |

* cited by examiner

*Primary Examiner* — James E McDonough
(74) *Attorney, Agent, or Firm* — Hayes Soloway P.C.

(57) ABSTRACT

Disclosed is a gas generating polymer compound that when irradiated with light or other radiation sources makes a solid to gas phase transition due to chemically catylized degradation, irradiative degradation or both. This provides a low cost, stable and easily manufactured means of gas production. Also disclosed are possible uses for the gas generator such as a low cost micro thruster.

24 Claims, 2 Drawing Sheets

MICRO THRUSTER, MICRO THRUSTER ARRAY AND POLYMER GAS GENERATOR

CROSS REFERENCE TO RELATED APPLICATION

This application claims priority under 35 U.S.C. 119 from Provisional Patent Application Ser. Nos. 60/621,015 filed Oct. 20, 2004 and 60/698,501, filed Jul. 11, 2005, which are incorporated by reference.

FIELD OF THE INVENTION

The present invention relates to micro thrusters, micro thruster arrays and polymer gas generators that are photo reactive or initiated and systems for their use.

DESCRIPTION OF PRIOR ART

Micro thrusters and micro thruster arrays typically are fabricated expensive using semi conductor materials. Such devices are difficult and expensive to manufacture. U.S. Pat. No. 6,378,292 to Youngner, issued Apr. 30, 2002, describes a microelectrical mechanical system (MEMS) micro thruster array. The MEMS micro thruster array described can be used for maintaining inter satellite distance in small satellites. One micro thruster array includes numerous micro thruster propulsion cells, each having a vacuum enclosed explosive igniter disposed on one side by a breakable diaphragm and having a propellant-filled chamber on the opposite side of the diaphragm. Upon explosion of the explosive igniter, the first diaphragm breaks, which, together with the explosion of the explosive igniter, causes the propellant to expand rapidly, thereby providing exhaust gases which are ejected from an exterior face of the micro thruster propulsion array, thereby providing a small unit of thrust.

SUMMARY OF THE INVENTION

The present invention provides improvements over existing micro thrusters and micro thruster arrays. More particularly, the present invention provides micro thruster and micro thruster arrays formed as one or an array of stable polymer gel gas generator cells molded or formed with the surrounding housing and then covered with a protective outer shell. The cells are activated by UV or other light wave length irradiation introduced, for example, at the back or other point of each cell via fiber optics. This design simplifies manufacturing and assembly, and achieves a substantial cost and weight reduction of the package by using compatible polymer materials. Using compatible materials eliminates the problems associated with bonding layers of dissimilar materials used in MEMS and other micro thruster fabrication. This design also eliminates assembly and storage problems associated with many propellants for further cost savings.

One configuration of the system uses UV photo acid generators that are suspended in polymer gel base material containing additional chemicals necessary to create a robust gas reaction when the photo acid is present. In turn this reaction produces a highly energetic and reactive gas. This gas can be used for thrust two ways: cold or with the addition of igniters hot for increased performance.

BRIEF DESCRIPTION OF THE DRAWINGS

Other features and advantages of the present invention will be seen from the following detailed description, taken in conjunction with the accompanying drawings, wherein.

DETAILED DESCRIPTION OF THE PREFERRED EMBODIMENTS

Gas generators are used for many functions but primarily as auto air bag inflators. These need a means of ignition and are basically controlled explosions that go through a catalytic chemical process. See, U.S. Pat. No. 6,864,295 to Mitarai issued Mar. 8, 2005, which describes a gas-generating, pressure-sensitive adhesive composition comprising a pressure-sensitive, ultraviolet irradiation-curable adhesive containing a photoinitiator, wherein the adhesive allows through ultraviolet radiation, and a gas generator compound which generates a gas upon irradiation with an ultraviolet radiation, the gas generator compound generates a gas and the gas effuses at an interface between the gas-generating, pressure-sensitive adhesive composition to thereby facilitate release of the pressure-sensitive adhesive composition.

Figure 1:
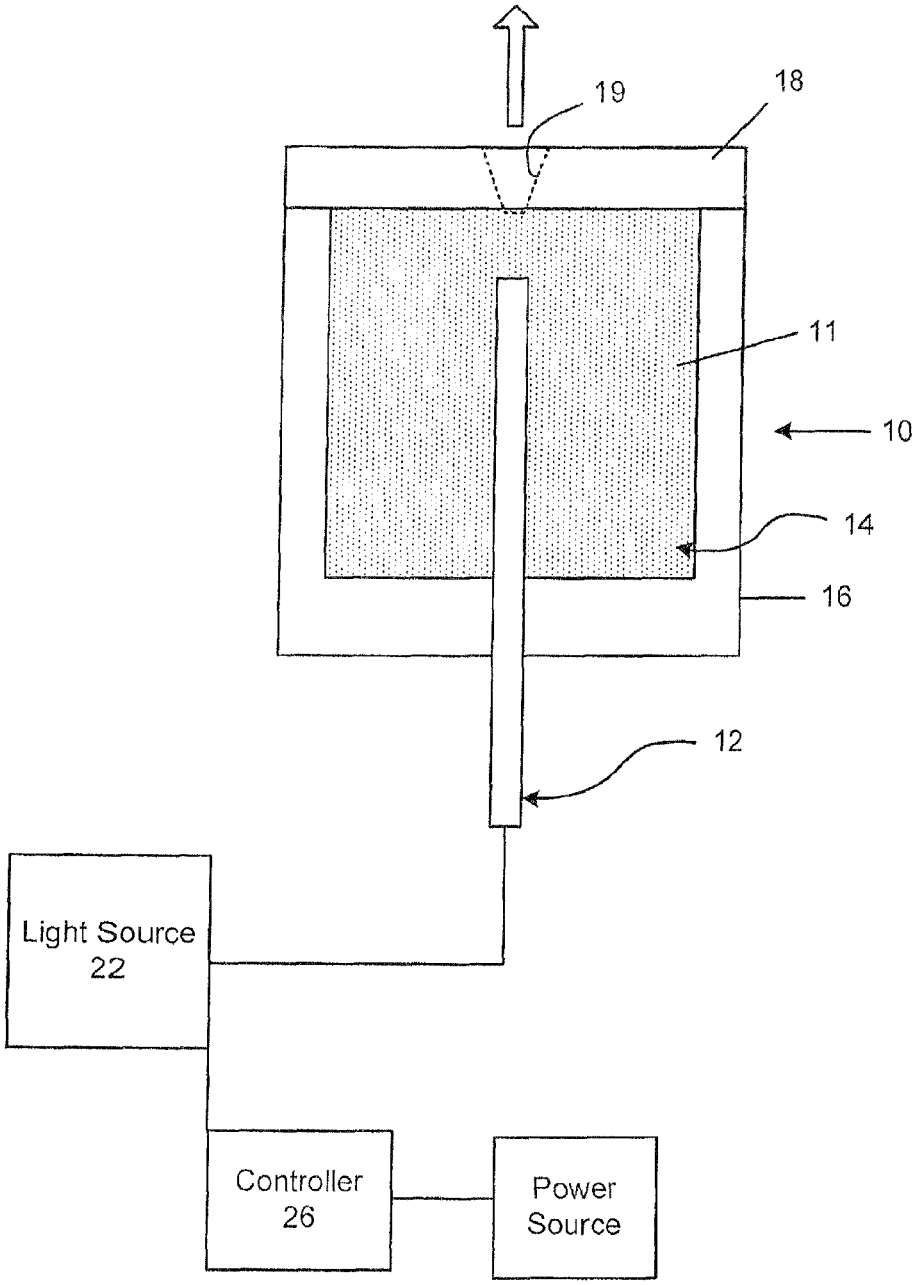
FIG. 1 is a cross-sectional view of a micro thruster.

Referring to FIG. 1, a micro thruster cell 10 made in accordance with the present invention comprises a base 16 with a well 11 with embedded fiber optics 12. A reactive polymer 14 is contained in well 11, and covered with a protective cover or shell 18 having an orifice or weakened area 19.

Figure 2:
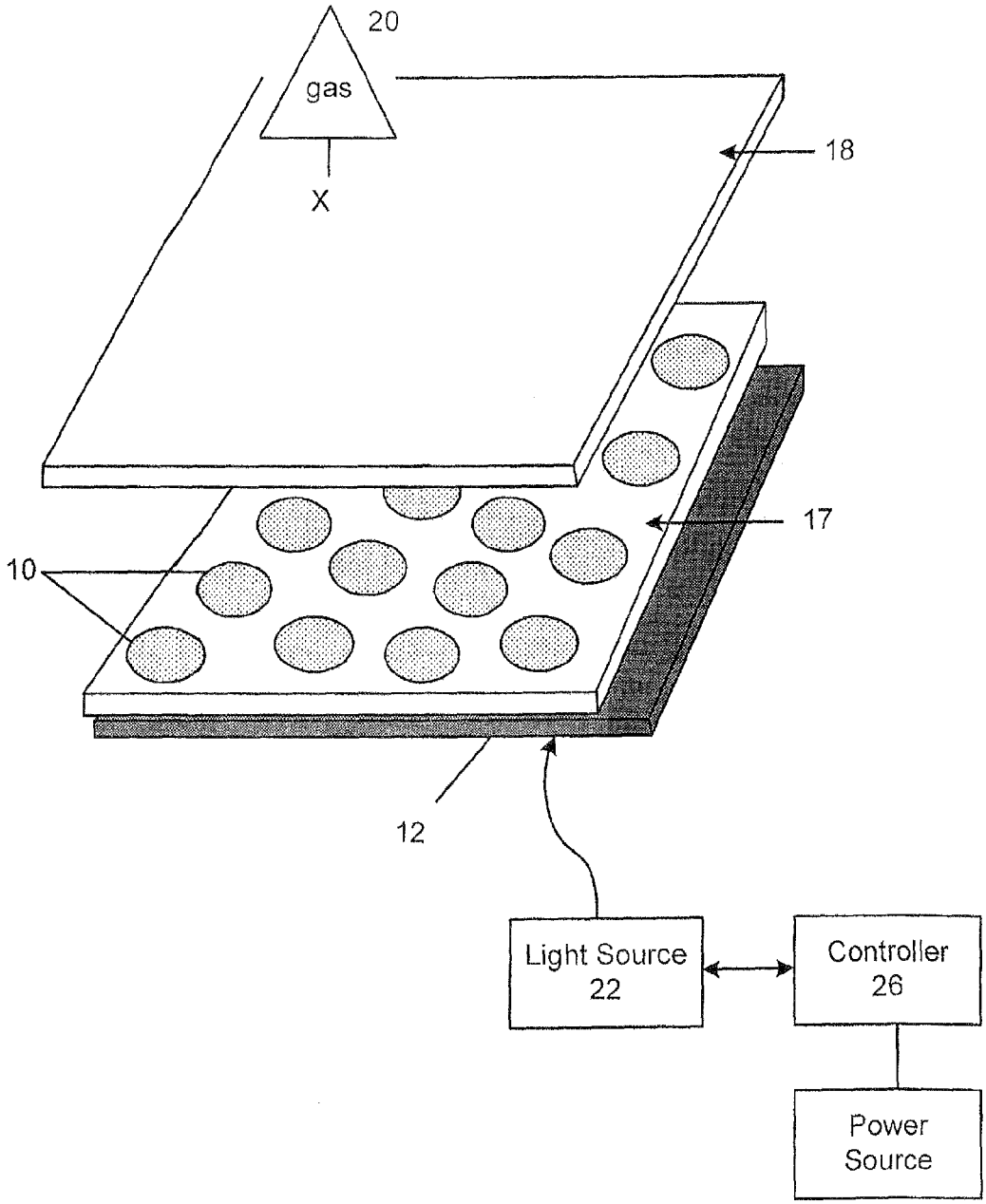
FIG. 2 is a partially exploded perspective view of a micro thruster array made in accordance with a preferred embodiment of the present invention.

Referring also to FIG. 2, a plurality of cells 10 may be assembled, suspended or confined within a polymer gel base 17.

Once the body and cells are formed the outer shell cover material could be applied so that the cell cover can burst, at a predetermined pressure, at points over each gas generator. Possible shell coating materials are ceramic polymer compositions, polymer composites, polymer metal composites.

Various gas generating polymers are available commercially and advantageously can be used in accordance with the present invention. Generally, the gas generating polymer composition comprises a photo acid generator (A) and a polymer (B) that has a chain or branches susceptible to acidylic attack and converts to gas when the chain is cleaved by acid formed from photo irradiation of said photo acid generator (A). Preferred are photo acid generators (PAG) such as Trisulfonium acid and other photo acid generators commercially available from chemical companies such as CIGMA Aldrich of Milwaukee, Wis. In a preferred embodiment of the invention, the photo acid generators may be chemically amplified using photo initiators.

In a particularly preferred embodiment the polymer, Acetal resin or Polyoxymethylene is mixed with photo acid generators or its chain end capped with photo initiators. The polymer readily decomposes to the gas formaldehyde both in the presence of acids and UV radiation. Acetal resin is also attractive for its ability to be engineered and copolymerized. This allows the reaction gas or products to be engineered to produce a highly energetic and reactive gas. This gas can be used for thrust two ways cold or with the addition of igniters or combustion chamber hot for increased performance. The scope of the invention is not meant to be limited to the use of Acetal resins as the polymer compounds, for there are an abundance of highly engineered polymers and copolymers available.

Acetal resin is cryogenically pulverized to micron sized powder and mixed with the photo acid per the process needed for the PAG; this process is material specific and would be obvious to anyone in the art. The PAG is then put into the thruster cavity or body. It can also be put into molds and cured into a solid or gel. The micro thruster consist of a body or cavity that is machined, molded or assembled using a polymer or polymer ceramic hybrid material that is not susceptible to acid or photo degradation.

Within the body or cavity are means for light transmission such as fiber optics that channel the photo energy to the PAG and polymer mixture. Acetal resin degrades in a boundary layer when the acid and light are present so the mixture can be illuminated from the center axis out by using a side illuminating fiber optic strand, by embedding an LED, or laser chip into the micro thruster cavity.

Once the body and gas generating material are assembled they can be capped with compatible material such as a ceramic polymer slurry that can be poured sprayed or cast to the body, cured thus sealing in the gas generating material. This may be sufficient protection and encapsulation or a protective outer layer may need to be applied depending on the environment the thruster needs to work in this outer layer may consist of metal thin film, ceramic polymer, composites etc. the outer shell coating material would be applied so that the sell can burst, at a predetermined pressure, at points over each gas generator. Electrodes or igniters may also need to be added also dependant on the working environment and performance requirements The micro thruster or array is then attached to a power and control source and added to the system it is designed for.

The system includes a controller such as a microprocessor controller 26 which controls via electronic/photonic switching one or more UV light sources 22. These can be in the form of LEDs for the lowest cost of laser chips to ensure system reliability. By applying simple chemistry it is possible to build a low cost controllable and consumable on demand gas generation system activated with low power (<2v) UV irradiation.

Operation of the micro thruster array is quite straight forward. When one turns on the UV light source the reactive polymer produces gas; turn off the light source and the gas generation stops. This reactive polymer can be consumable or non-consumable and easily manufactured. The assembly of components can be accomplished via molding or cutting the polymer base and polymer gas generators to shape, and then depositing or coating the shell material to complete micro thruster array. The design lends itself to high production principals with very few steps of assembly and can be made in sheet or strip forms. Moreover, the systems array can be integrated directly into other interceptor parts reducing assembly, cost and weight even further.

In summary the invention provides a gas generating system that when the irradiative source is activated the gas generating material produces gas, turn it off and the gas generation stops. This material can be consumable or non consumable and easily manufactured. The assembly of components can be accomplished via molding or cutting the materials to shape and then depositing or coating the shell material over the complete micro thruster array, lamination of sheets of material is another option for this process. The design lends itself to high production principals with very few steps of assembly and can be made in sheet or strip forms.

There are many variations of the invention possible and this description is not meant to limit the scope of the invention or its variables such as polymer compositions, types of gas generated, light wavelength and power and source, controller and main power source.

What is claimed is:

1. A gas generating polymer composition comprising: a photo acid generator (A) and a polymer (B) that has a chain or branches susceptible to acidylic attack and converts to gas when the chain is cleaved by acid formed from photo irradiation of said photo acid generator (A).

2. A gas generating polymer composition according to claim 1, wherein said polymer (B) is subject to photo degradation and converts to gas under photo irradiation.

3. A gas generating polymer composition according to claim 1, further comprising a photo initiator.

4. A gas generating polymer composition comprising: a polymer (B) that has a chain or branches susceptible to acidylic attack that have one or more end caps with a photo acid generator (A).

5. A gas generating polymer composition according to claim 4, wherein said polymer (B) is subject to photo degradation and converts to gas under photo irradiation.

6. A gas generating polymer composition according to claim 4, further comprising a photo initiator.

7. A gas generating polymer composition according to claim 1, wherein composition is used as a binder or ingredient in a solid rocket propellant.

8. A gas generating polymer composition according to claim 4, wherein composition is used as a binder or ingredient in a solid rocket propellant.

9. A gas generating polymer composition according to claim 1, wherein composition is used as a propellant for a micro thruster.

10. A gas generating polymer composition according to claim 1, wherein gas generated is used as a propellant for a micro thruster.

11. A gas generating polymer composition according to claim 4, wherein composition is used as a propellant for a micro thruster.

12. A gas generating polymer composition according to claim 4, wherein gas generated is used as a propellant for a micro thruster.

13. A gas generating polymer composition according to claim 1, wherein composition is used as a propellant for a micro thruster array.

14. A gas generating polymer composition according to claim 1, wherein gas generated is used as a propellant for a micro thruster array.

15. A gas generating polymer composition according to claim 4, wherein composition is used as a propellant for a micro thruster array.

16. A gas generating polymer composition according to claim 4, wherein gas generated is used as a propellant for a micro thruster array.

17. A gas generating polymer composition according to claim 1, wherein composition is used as a propellant for an inflation device.

18. A gas generating polymer composition according to claim 4, wherein composition is used as a propellant for an inflation device.

19. A gas generating polymer composition according to claim 1, wherein composition is used as a propellant for a pressurized pump system.

20. A gas generating polymer composition according to claim 4, wherein composition is used as a propellant for a pressurized pump system.

21. A micro thruster comprising a gas generating propellant, wherein the gas generating propellant comprises a gas generating polymer composition as claimed in claim 1.

22. The micro thruster according to claim 21, wherein the polymer (B) is subject to photo degradation and converts to a gas under photo irradiation.

23. The micro thruster according to claim 21, wherein the gas generating polymer composition further comprises a polymer (C) that is subject to photo degradation and converts to a gas under photo irradiation.

24. The micro thruster according to claim 21, wherein the gas generating polymer composition further comprises a photo initiator.

* * * * *

UNITED STATES PATENT AND TRADEMARK OFFICE

CERTIFICATE OF CORRECTION

PATENT NO. : 7,931,761 B2
APPLICATION NO. : 12/414536
DATED : April 26, 2011
INVENTOR(S) : Banister et al.

It is certified that error appears in the above-identified patent and that said Letters Patent is hereby corrected as shown below:

Title Page, Insert

-- (62) This application is a DIV of 11/254,537 10/20/2005 PAT 7,544,260 --

Signed and Sealed this
Sixteenth Day of October, 2012

David J. Kappos

David J. Kappos
*Director of the United States Patent and Trademark Office*